US006897831B2

(12) United States Patent
McKinzie, III et al.

(10) Patent No.: US 6,897,831 B2
(45) **Date of Patent: *May 24, 2005**

(54) RECONFIGURABLE ARTIFICIAL MAGNETIC CONDUCTOR

(75) Inventors: William E. McKinzie, III, Fulton, MD (US); Victor C. Sanchez, Laurel, MD (US); Mark Reed, Laurel, MD (US); Steven L. Garrett, Jessup, MD (US)

(73) Assignee: Titan Aerospace Electronic Division, Greenbelt, MD (US)

( * ) Notice: Subject to any disclaimer, the term of this patent is extended or adjusted under 35 U.S.C. 154(b) by 122 days.

This patent is subject to a terminal disclaimer.

(21) Appl. No.: 09/845,666

(22) Filed: Apr. 30, 2001

(65) Prior Publication Data

US 2002/0167457 A1 Nov. 14, 2002

(51) Int. Cl.[7] ..... H01Q 15/02
(52) U.S. Cl. ..... 343/909; 343/700 MS
(58) Field of Search ..... 343/909, 700 MS, 343/756, 850, 853, 846, 848, 753; H01Q 15/02

(56) References Cited

U.S. PATENT DOCUMENTS

| | | | | |
|---|---|---|---|---|
| 4,367,474 A | * | 1/1983 | Schaubert et al. | 343/700 MS |
| 4,751,513 A | * | 6/1988 | Daryoush et al. | 343/700 MS |
| 5,511,238 A | * | 4/1996 | Bayraktaroglu | 343/700 MS |
| 6,175,337 B1 | | 1/2001 | Jasper, Jr. et al. | 343/770 |
| 6,292,143 B1 | * | 9/2001 | Romanofsky | 343/700 MS |
| 6,426,722 B1 | * | 7/2002 | Sievenpiper et al. | 343/700 MS |
| 6,525,695 B2 | * | 2/2003 | McKinzie | 343/756 |
| 6,538,621 B1 | * | 3/2003 | Sievenpiper et al. | 343/909 |
| 2003/0011518 A1 | | 1/2003 | Sievenpiper et al. | 343/700 |
| 2003/0112186 A1 | * | 6/2003 | Sanchez et al. | 343/700 MS |

FOREIGN PATENT DOCUMENTS

| | | |
|---|---|---|
| WO | WO 99/50929 | 10/1999 |
| WO | WO 01/24313 A1 | 4/2001 |
| WO | WO 01/73891 A1 | 10/2001 |
| WO | WO 01/73892 A2 | 10/2001 |
| WO | WO 01/73893 A1 | 10/2001 |

OTHER PUBLICATIONS

R. J. King and K.S. Park, "Synthesis of surface reactances using grounded pin bed structure," *Electronics Letters*, vol. 17, 1981, pp. 52–53.

S. M. Sze, "Physics of Semiconductor Devices—Chapter 2.7.4 Varactor", published by Wiley & Sons, 1981, pp 114–122.

(Continued)

*Primary Examiner*—Hoanganh Le
(74) *Attorney, Agent, or Firm*—Brinks Hofer Gilson & Lione

(57) ABSTRACT

An electronically reconfigurable artificial magnetic conductor (RAMC) includes a frequency selective surface (FSS) having an effective sheet capacitance which is variable to control resonant frequency of the RAMC. In one embodiment, the RAMC further includes a conductive backplane structure and a spacer layer separating the conductive backplane structure and the FSS. The spacer layer includes conductive vias extending between the conductive backplane structure and the FSS, and voltage variable capacitive circuit elements coupled with the FSS and responsive to bias voltages applied on one or more bias signal lines routed through the conductive backplane structure and the conductive vias.

43 Claims, 12 Drawing Sheets

OTHER PUBLICATIONS

Ray. J. King, David. V. Theil. and Kwang S. Park, "The synthesis of surface reactances using an artificial dielectric," *IEEE Trans. Antennas and Propagation*, vol. AP–31, No. 3, May 1983, pp. 471–476.

R. M. Walser et. al., "New smart materials for adaptive microwave signature control," *Proceedings of the Society of Photo–Optical Instrumentation Engineers* (*SPIE*), vol. 1916, 1993, pp. 128–134.

John C. Vardaxoglou, "*Frequency Selective Surfaces: Analysis and Design*, " Research Studies Press Ltd, Copyright 1997, pp 1–9, 18–73, 116–152 and 221–273.

Daniel F. Sievenpiper, "High–impedance electromagnetic surfaces," Ph.D. dissertation, UCLA electrical engineering department, filed Jan. 1999.

D. Sievenpiper, L. Zhang, and E. Yablonovitch, "High–impedance ground planes," *IEEE Intl. MTT Symp.*, Jun. 13–19, 1999, Anaheim, CA.

D. Sievenpiper, R. Broas, and E. Yablonovitch, "Antennas on high–impedance ground planes," *IEEE Intl. MTT Symp.*, Jun. 13–19, 1999, Anaheim, CA.

L. Zhang, N. G. Alexopoulos, D. Sievenpiper, and E. Yablonovitch, "An efficient finite–element method for the analysis of photonic bandgap materials," *IEEE Intl. MTT Symp.*, Jun. 13–19, 1999, Anaheim, CA.

Dan Sievenpiper Lijun Zhang, Romulo F. Jimenez Broas, Nicolaos G. Alexopoulos, and Eli Yablonovitch, "High–impedance electromagnetic surfaces with a forbidden frequency band," *IEEE Trans. Microwave Theory and Techniques*, vol. 47, No. 11, Nov. 1999, pp. 2059–2074.

Ruey Bing Hwang and Song Tsuen Peng, "Guidance Characteristics of Two–Dimensionally Periodic Impedance Surface", *IEEE Trans. Microwave Theory and Techniques*, vol. 47, No. 12, Dec. 1999, pp. 2503–2511.

Rudolfo E. Diaz, James T. Aberle, and William E. McKinzie III, "TM mode analysis of a Sievenpiper high–impedance reactive surface," *IEEE Intl. Antennas and Propagation Symp.* Jul. 16–21, 2000, Salt Lake City, Utah. pp. 327–330.

M. Rahman and M. A. Stuchly, "Equivalent circuit model of 2D microwave photonic bandgap structures," *URSI National Radio Science Meeting*, Jul. 16–21, 2000, Salt Lake City, Utah, pp. 322.

G. Poilasne and E. Yablonovitch, "Matching antennas over high–impedance ground planes," *URSI National Radio Science Meeting*, Jul. 16–21, 2000, Salt Lake City, Utah, pp. 312.

H. Y. D. Yang, R. Kim and D. R. Jackson, "Surface–Wave Band Gaps and Leaky Modes On Integrated Circuit Structures With Planar Periodic Metallic Elements", IEEE MTT–S Digest, Copyright 2000, pp 1521–1524.

R. B. Hwang, S. T. Peng and C. C. Chen, "Surface–Wave Suppression of Resonance–Type Periodic Structures", IEEE MTT–S Digest, Copyright 2000, pp 1525–1528.

Ben A. Munk, "*Frequency Selective Surfaces, Theory and Design*," John Wiley and Sons, New York, Copyright 2000, pp 26–62 and 279–314.

R. J. King and S. W. Cho, "Surface Impedance Planes", Dept. of Electrical and Computer Engineering, University of Wisconsin, Copyright 2000, 16 pages.

D. Sievenpiper, H. Hsu, J. Schaffner R. Garcia and S. Ontiveros, "Low Profile, Four Sector Diversity Antenna on High Impedance Ground Plane," *Eelectronics Lett.*, vol. 36, No. 6, 1999, 2 pages.

Keisuke Kageyama et al., "Tunable Active Filters Having Multilayer Structure Using LTCC", IEEE, Copyright 2001, 4 pages.

Dan Sievenpiper, Jim Schaffner, Bob Loo, Greg Tangonan, Rick Harold, Joe Pikulski and Ray Garcia, "Electronic Beam Steering Using A Varactor–Tuned Impedance Surface," *IEEE Antennas and Propagation Society Intl. Symp*, vol. 1, as presented at the IEEE Antennas and Propagation International Symposium in Boston, MA., Jul., 2001, pp. 174–177.

Briefing Charts in color as presented at the IEEE Antennas and Propagation International Symposium in Boston MA., Jul., 2001, 13 pages.

D. Sievenpiper, J. Schaffner, B. Loo, G. Tangonan, R. Harold, J. Pikulski, R. Garcia, "Electronic Beam Steering Using a Varactor–Tuned Impedance Surface," 2001 IEEE Antennas and Propagation Society Int'l Symposium, Boston, MA, Jul. 8–13, 2001, vol. 1, pp. 174–177.

International Search Report, International Application No. PCT/US02/13542, dated Jul. 11, 2002.

* cited by examiner

1300

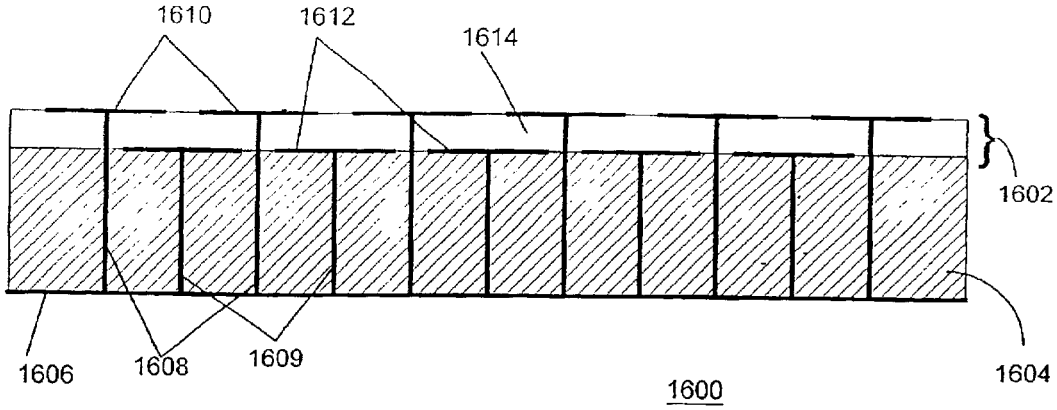
FIG. 16 - Prior art -
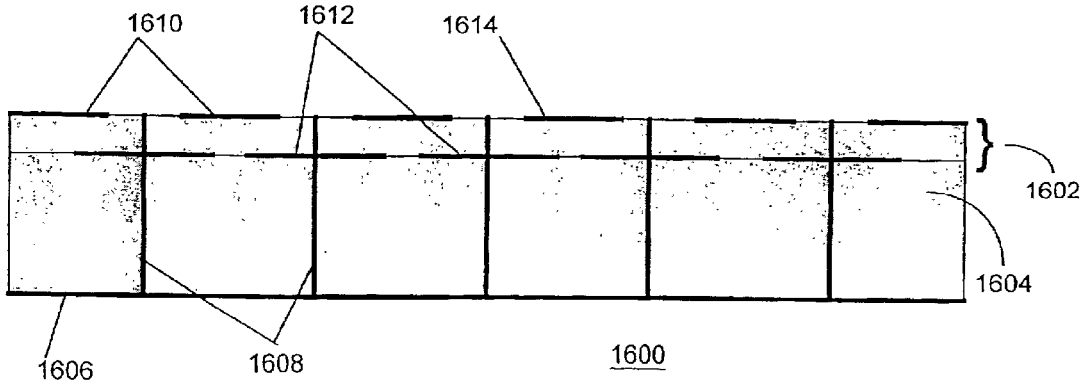
FIG. 17
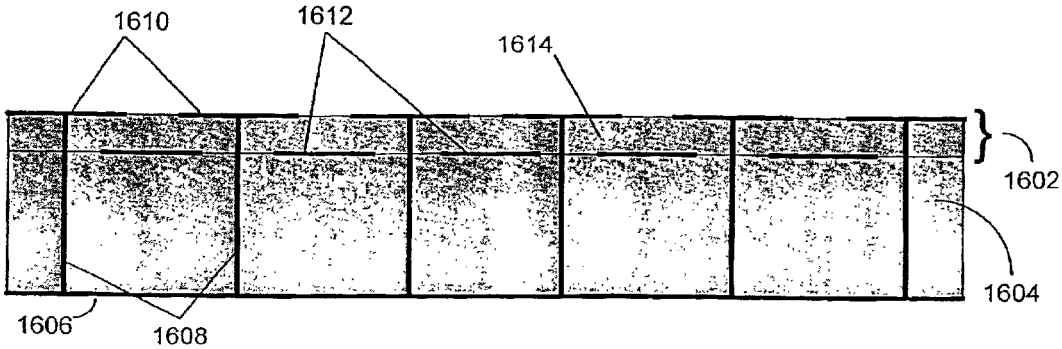
FIG. 18 1600

-Prior Art -

RECONFIGURABLE ARTIFICIAL MAGNETIC CONDUCTOR

RELATED APPLICATIONS

This application is related to U.S. Ser. No. 09/845,393, now U.S. Pat. No. 6,525,695, entitled RECONFIGURABLE ARTIFICIAL MAGNETIC CONDUCTOR USING VOLTAGE CONTROLLED CAPACITORS WITH COPLANAR RESISTIVE BIASING NETWORKS, which is commonly assigned with the present application and filed on even date herewith.

FEDERALLY SPONSORED RESEARCH

This invention was developed in part under DARPA Contract Number F19628-99-C-0080.

BACKGROUND

The present invention relates to the development of reconfigurable artificial magnetic conductor (RAMC) surfaces for low profile antennas. This device operates as a high-impedance surface over a tunable frequency range, and is electrically thin relative to the frequency of interest, λ.

A high impedance surface is a lossless, reactive surface, realized as a printed circuit board, whose equivalent surface impedance is an open circuit which inhibits the flow of equivalent tangential electric surface currents, thereby approximating a zero tangential magnetic field. A high-impedance surface is important because it offers a boundary condition which permits wire antennas (electric currents) to be well matched and to radiate efficiently when the wires are placed in very close proximity to this surface (<λ/100 away). The opposite is true if the same wire antenna is placed very close to a metal or perfect electric conductor (PEC) surface. It will not radiate efficiently. The radiation pattern from the antenna on a high-impedance surface is confined to the upper half space above the high impedance surface. The performance is unaffected even if the high-impedance surface is placed on top of another metal surface. The promise of an electrically-thin, efficient antenna is very appealing for countless wireless device and skin-embedded antenna applications.

One embodiment of a thin, high-impedance surface 100 is shown in FIG. 1. It is a printed circuit structure forming an electrically thin, planar, periodic structure, having vertical and horizontal conductors, which can be fabricated using low cost printed circuit technologies. The high-impedance surface or artificial magnetic conductor (AMC) 100 includes a lower permittivity spacer layer 104 and a capacitive frequency selective surface (FSS) 102 formed on a metal backplane 106. Metal vias 108 extend through the spacer layer 104, and connect the metal backplane to the metal patches of the FSS layer. The thickness of the high impedance surface 100 is much less than λ/4 at resonance, and typically on the order of λ/50, as is indicated in FIG. 1.

The FSS 102 of the prior art high impedance surface 100 is a periodic array of metal patches 110 which are edge coupled to form an effective sheet capacitance. This is referred to as a capacitive frequency selective surface (FSS). Each metal patch 110 defines a unit cell which extends through the thickness of the high impedance surface 100. Each patch 110 is connected to the metal backplane 106, which forms a ground plane, by means of a metal via 108, which can be plated through holes. The spacer layer 104 through which the vias 108 pass is a relatively low permittivity dielectric typical of many printed circuit board substrates. The spacer layer 104 is the region occupied by the vias 108 and the low permittivity dielectric. The spacer layer is typically 10 to 100 times thicker than the FSS layer 102. Also, the dimensions of a unit cell in the prior art high-impedance surface are much smaller than λ at the fundamental resonance. The period is typically between λ/40 and λ/12.

Another embodiment of a thin, high-impedance surface is disclosed in U.S. patent application Ser. No. 09/678,128, entitled "Multi-Resonant, High-Impedance Electromagnetic Surfaces," filed on Oct. 4, 2000, commonly assigned with the present application and incorporated herein by reference. In that embodiment, an artificial magnetic conductor is resonant at multiple resonance frequencies. That embodiment has properties of an artificial magnetic conductor over a limited frequency band or bands, whereby, near its resonant frequency, the reflection amplitude is near unity and the reflection phase at the surface lies between +/−90 degrees. At the resonant frequency of the AMC, the reflection phase is exactly zero degrees. That embodiment also offers suppression of transverse electric (TE) and transverse magnetic (TM) mode surface waves over a band of frequencies near where it operates as a high impedance surface.

Another implementation of a high-impedance surface, or an artificial magnetic conductor (AMC), which has nearly an octave of +/−90° reflection phase, was developed under DARPA Contract Number F19628-99-C-0080. The size of this exemplary AMC is 10 in. by 16 in by 1.26 in thick (25.4 cm×40.64 cm×3.20 cm). The weight of the AMC is 3 lbs., 2 oz. The 1.20 inch (3.05 cm) thick, low permittivity spacer layer is realized using foam. The FSS has a period of 298 mils (0.757 cm), and a sheet capacitance of 0.53 pF/sq. The FSS substrate had a thickness of 0.060 inches, and was made using Rogers R04003 material. The FSS was fabricated using two layers of metallization, where the overlapping patches were essentially square in shape.

The measured reflection coefficient phase of this broadband AMC, referenced to the top surface of the structure is shown in FIG. 2 as a function of frequency. A ±90° phase bandwidth of 900 MHz to 1550 MHz is observed. Three curves are traced on the graph, each representing a different density of vias within the spacer layer. For curve AMC1–2, one out of every two possible vias is installed, and only the upper patches are connected to the vias. For curve AMC1–4, one out of every four vias is installed. In this case, only half of the upper patches are connected to vias, and the patches connected form a checkerboard pattern. For curve AMC1–18, one out of every 18 vias is installed. In this third case, only one in every 9 of the upper patches has an associated via. As expected from the effective media model described in application Ser. No. 09/678,128, the density of vias does not have a strong effect on the reflection coefficient phase.

Transmission test set-ups are used to experimentally verify the existence of a surface wave bandgap for this broadband AMC. In each case, the transmission response ($S_{21}$) is measured between two Vivaldi-notch radiators that are mounted so as to excite the dominant electric field polarization for transverse electric (TE) and transverse magnetic (TM) modes on the AMC surface. For the TE set-up, the antennas are oriented horizontally. For the TM set-up, the antennas are oriented vertically. Absorber is placed around the surface-under-test to minimize the space wave coupling between the antennas. The optimal configuration—defined empirically as "that which gives the smoothest, least-noisy response and cleanest surface wave cutoff"—is obtained by trial and error. The optimal configuration is obtained by varying the location of the antennas, the placement of the absorber, the height of absorber above the surface-under-test, the thickness of absorber, and by placing a conducting foil "wall" between layers of absorber to mitigate free space coupling between test antennas. The measured $S_{21}$ for both configurations is shown in FIG. 3. As can be seen, a sharp TM mode cutoff occurs near 950 MHz, and a gradual TE mode onset occurs near 1550 MHz. The difference between these two cutoff frequencies is referred to as a surface wave bandgap. This measured bandgap is correlated closely to the +/−90-degree reflection phase bandwidth of the AMC illustrated in FIG. 2.

The resonant frequency of the prior art AMC, shown in FIG. 1, is given by Sievenpiper et. al. (*IEEE Trans. Microwave Theory and Techniques*, Vol. 47, No. 11, November 1999, pp. 2059–2074), (also see "High Impedance Electromagnetic Surfaces," dissertation of Daniel F. Sievenpiper, University of California at Los Angeles, 1999) as $f_o=1/(2\pi\sqrt{LC})$ where C is the equivalent sheet capacitance of the FSS layer in Farads per square, and $L=\mu_o h$ is the permeance of the spacer layer, with h denoting the height or thickness of this layer.

In most wireless communications applications, it is desirable to make the antenna ground plane as small and light weight as possible so that it may be readily integrated into physically small, light weight platforms such as radiotelephones, personal digital assistants and other mobile or portable wireless devices. The relationship between the instantaneous bandwidth, BW, of an AMC with a non-magnetic spacer layer and its thickness is given by $$\frac{BW}{f_0} = 2\pi\frac{h}{\lambda_0}$$

where $\lambda_0$ is the free space wavelength at resonance where a zero degree reflection phase is observed. Thus, to support a wide instantaneous bandwidth, the AMC thickness must be relatively large. For example, to accommodate an octave frequency range ($BW/f_o=0.667$), the AMC thickness must be at least 0.106 $\lambda_0$, corresponding to a physical thickness of 1.4 inches at a center frequency of 900 MHz. This thickness is too large for many practical applications.

Accordingly, there is a need for an AMC which allows for a larger reflection phase bandwidth for a given AMC thickness.

BRIEF SUMMARY

The present invention provides a means to electronically adjust or tune the resonant frequency, $f_o$, of an artificial magnetic conductor (AMC) by controlling the effective sheet capacitance C of its FSS layer.

By way of introduction only, one present embodiment provides an artificial magnetic conductor (AMC) which includes a frequency selective surface (FSS) having an effective sheet capacitance which is variable to control the resonant frequency of the AMC.

Another embodiment provides an AMC which includes a frequency selective surface (FSS), a conductive backplane structure, and a spacer layer separating the conductive backplane structure and the FSS. The spacer layer includes conductive vias extending between the conductive backplane structure and the FSS. The AMC further includes voltage variable capacitive circuit elements coupled with the FSS and responsive to one or more bias signal lines routed through the conductive backplane structure and the conductive vias.

Another embodiment provides an AMC which includes a frequency selective surface (FSS) including a periodic array of conductive patches, a spacer layer including vias extending therethrough in association with predetermined conductive patches of the FSS, and a conducting backplane structure including two or more bias signal lines. The FSS is characterized by a unit cell which includes, in a first plane, a pattern of three or more conductive patches, one conductive patch of which is electrically coupled with an associated conductive via, and voltage variable capacitive elements between laterally adjacent conductive patches. In a second plane, the FSS is characterized by a conductive backplane segment extending in a plane substantially parallel to a plane including the three or more conductive patches and the associated conductive via extending from the one conductive patch to one of the two or more bias signal lines.

Another embodiment provides an AMC which includes a frequency selective surface (FSS) including a periodic array of conductive patches, a spacer layer including vias extending therethrough in association with predetermined conductive patches of the FSS, and a conducting backplane structure including two or more bias signal lines. The FSS is characterized by a unit cell which includes, in a first plane, a pattern of three or more conductive patches disposed on a first side of a dielectric layer, each conductive patch being electrically coupled with an associated conductive via, and voltage variable capacitive elements between laterally adjacent conductive patches. Each conductive patch overlaps at least in part a spaced conductive patch of a plurality of spaced conductive patches disposed on a second side of the dielectric layer. In a second plane, a conductive backplane segment extends in a plane substantially parallel to a plane including the three or more conductive patches and the associated conductive vias extending from the each conductive patch to one of the two or more bias signal lines.

Another embodiment provides a method for reconfiguring an AMC including a frequency selective surface (FSS) having a pattern of conductive patches, a conductive backplane structure and a spacer layer separating the FSS and the conductive backplane structure. The method comprises applying control bias signals to voltage variable capacitive elements associated with the FSS; and thereby, reconfiguring the effective sheet capacitance of the FSS.

The foregoing summary has been provided only by way of introduction. Nothing in this section should be taken as a limitation on the following claims, which define the scope of the invention.

BRIEF DESCRIPTION OF SEVERAL VIEWS OF THE DRAWINGS

FIG. 16 is a cross sectional view of a prior art artificial magnetic conductor;

FIG. 17 is a cross sectional view of a first embodiment of an artificial magnetic conductor with a reduced number of vias in the spacer layer; and FIG. 18 is a cross sectional view of a second embodiment of an artificial magnetic conductor with a reduced number of vias in the spacer layer;

DETAILED DESCRIPTION OF THE PRESENTLY PREFERRED EMBODIMENTS

Figure 1:
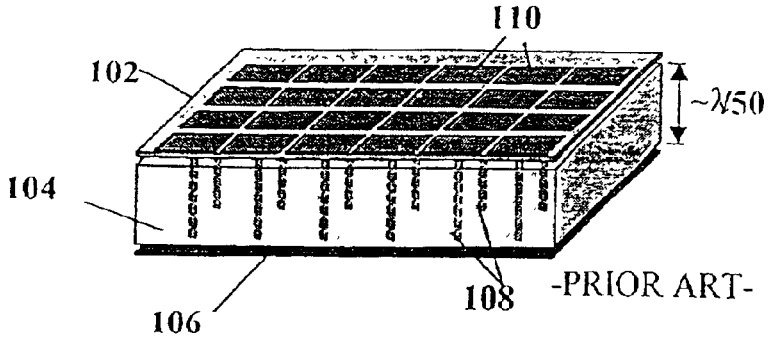
FIG. 1 is a perspective view of a prior art high impedance surface.
Figure 2:
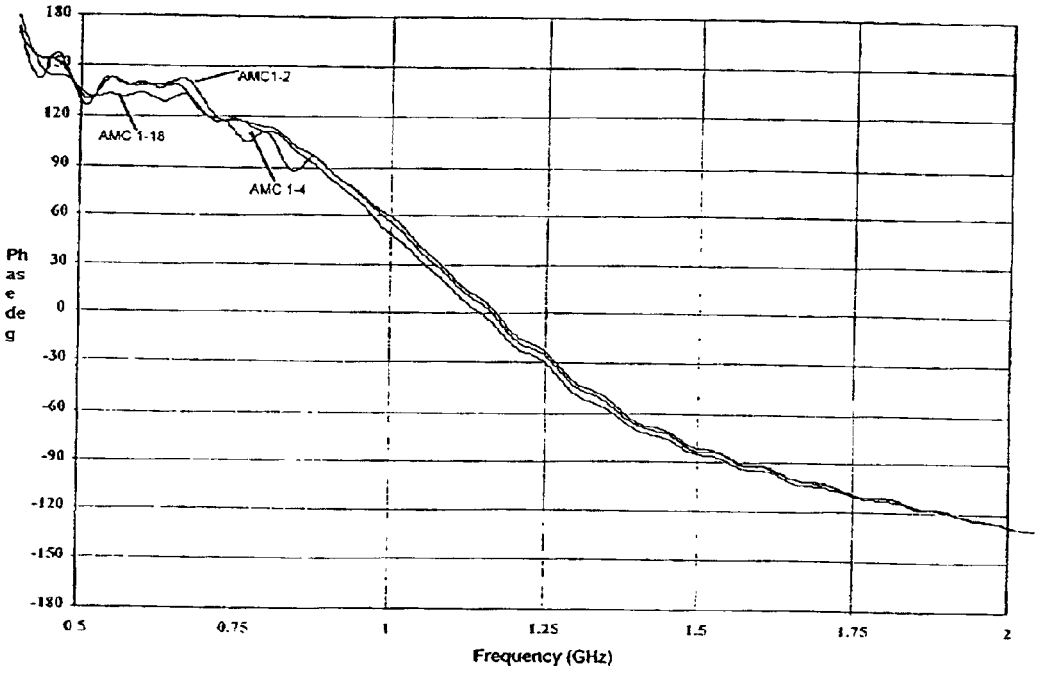
FIG. 2 illustrates measured reflection coefficient phase of a non-reconfigurable high-impedance surface.
Figure 3:
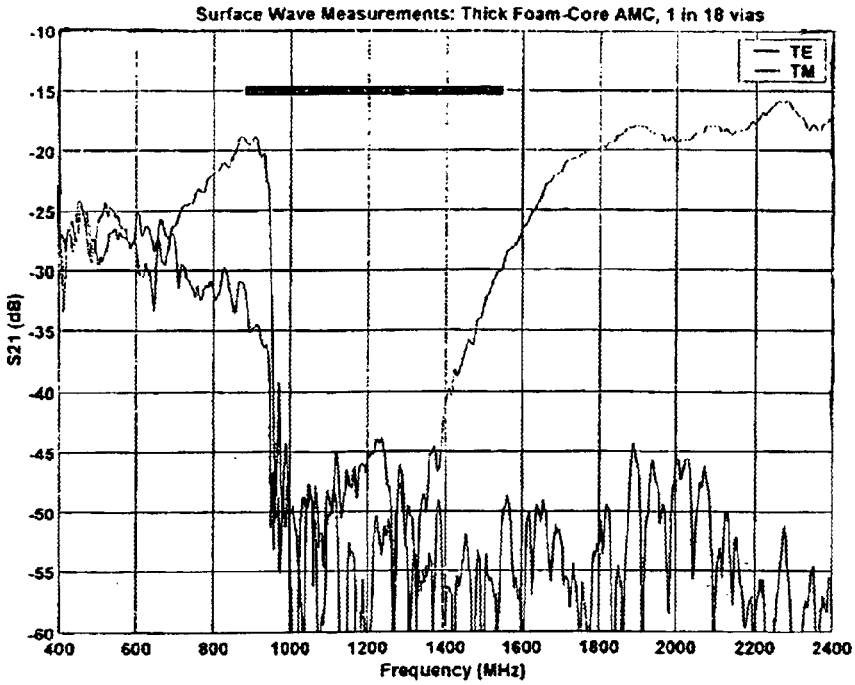
FIG. 3 illustrates transmission response for a high-impedance surface.
Figure 4:
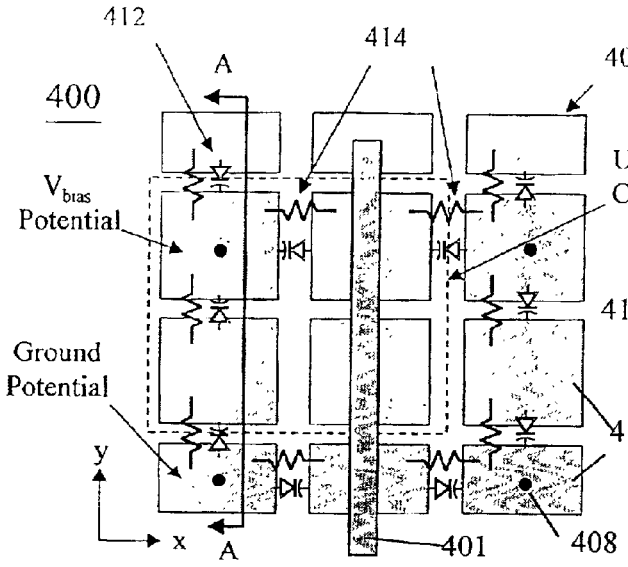
FIG. 4 is a top view of one embodiment of a reconfigurable artificial magnetic conductor.
Figure 5:
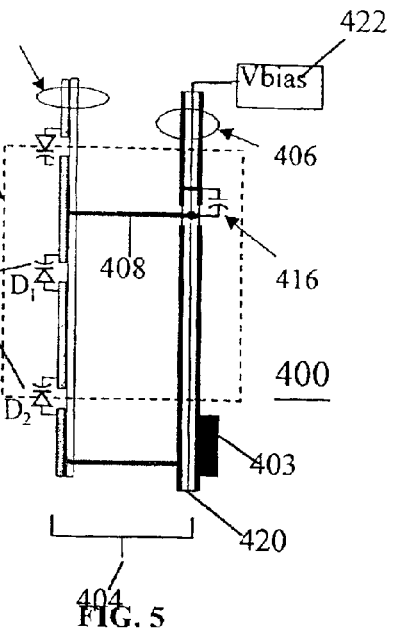
FIG. 5 is a cross sectional view taken along line A—A in FIG. 4.

FIG. 4 is a top view of one embodiment of a reconfigurable artificial magnetic conductor (RAMC) 400. FIG. 5 is a cross sectional view of the RAMC 400 taken along line A—A in FIG. 4. The RAMC 400, like other artificial magnetic conductors, forms a high impedance surface having particular applicability, example, in conjunction with antennas and other electromagnetic devices.

The RAMC 400 has a frequency selective surface (FSS) 402, which has a variable effective sheet capacitance to control resonant frequency of the RAMC. The capacitance of the FSS 402 is variable under control of a control circuit which operates in conjunction with the RAMC 400. For example, the RAMC 400 may be integrated with a radio transceiver, which controls tuning, reception and transmission of radio signals through an antenna formed in part by the RAMC 400. As part of the tuning process, which selects a frequency for reception or transmission, the control circuit applies appropriate signals to control the capacitance of the FSS 402 to control the resonant frequency of the RAMC 400.

The RAMC 400 further includes a spacer layer 404, a radio frequency (RF) backplane 406 and metal vias 408. The FSS 402 includes a pattern of conductive patches 410. In preferred embodiments, the FSS 402 includes a periodic array of patches 410. In the illustrated embodiment, the conductive patches 410 are made of a metal or metal alloy. In other embodiments, other conductive materials may be used. Further, in the illustrated embodiment, the conductive patches 410 are arranged in a regular pattern and the patches themselves are substantially square in shape. In alternative embodiments, other patch shapes, such as circular, diamond, hexagonal or triagonal, and other patch patterns may be used. Furthermore, all the patches need not be identical in shape. For instance, the patches to which vias 408 are connected may be larger in surface area, while the patches without vias may be reduced in size, without changing the period of the RAMC 400. Still further, a pattern of conductive patches includes patches on a single layer as well as patches disposed in two or more layers and separated by particular materials.

Particular geometrical configurations may be chosen to optimize performance factors such as resonance frequency or frequencies, size, weight, and so on. In one embodiment, the FSS 402 is manufactured using a conventional printed circuit board process to print the patches 410 on one or both surfaces of the FSS and to produce plated through holes to form the vias. Other manufacturing technology may be substituted.

The vias selectively excite patches 410 of the FSS 402 with a bias voltage applied through the RF backplane 406. The vias 408 are used to route DC bias currents and voltage from stripline control lines 420 buried inside the RF backplane. The RF backplane 406 includes one or more ground planes and one or more conductive striplines 420 or a stripline circuit with one or more bias control signals routed in between ground planes of the stripline circuit. The conductive striplines 420 may be biased using one or more external voltage sources such as voltage source 422. In the illustrated embodiment, the voltage source 422 applies a bias voltage $V_{bias}$ between a bias stripline and a ground plane at the surface of the RF backplane 406. Selected vias 408 are electrically coupled with the bias stripline and first alternating patches so that the first alternating patches are a potential $V_{bias}$. Similarly, other selected vias 408 are electrically coupled with the ground plane or a grounded stripline of the RF backplane 406 and with second alternating patches so that the second alternating patches are at ground potential. In this manner, the bias voltage $V_{bias}$ is applied between the alternating patches. Thus, the bias voltages are applied to the FSS 402 through the RF backplane 406 using the stripline or other conductors of the backplane 406 and the vias 408. In alternative embodiments, other bias voltages including time varying biasing signals may be applied in this manner through the RF backplane 406. Using time varying bias control signals, it is possible to modulate the reflection phase of the RAMC, and to convey information to a remote transponder via the phase of the monostatic or bistatic radar cross section presented by the RAMC. No RF transmit power is required at the RAMC. The process of reflecting a modulated signal for communication purposes is known as passive telemetry.

Further, the RAMC 400 includes variable capacitive elements 412, ballast resistors 414 and bypass capacitors 416. In the illustrated embodiment of FIG. 4, the variable capacitive elements are embodied as varactor diodes. A varactor or varactor diode is a semiconductor device whose capacitive reactance can be varied in a controlled manner by application of a bias voltage. Such devices are well known and may be chosen to have particular performance features. The varactor diodes 412 are positioned between and connected to adjacent patches of the FSS 402. The varactor diodes 412 add a voltage variable capacitance in parallel with the intrinsic capacitance of the FSS 402, determined primarily by edge-to-edge coupling between adjacent patches. The bias voltage for the varactor diodes 412 may be applied using the bias voltage source 422. More than one bias voltage may be applied and routed in the RAMC 400 using striplines 420 of the backplane 406 and vias 408. The magnitude of the bias signals may be chosen depending on the materials and geometries used in the RAMC 400. Thus, the local capacitance of the FSS 402 may be varied to control the overall resonant frequency of the RAMC 400. In an alternative embodiment, the conductive backplane structure comprises a stripline circuit and distributed or lumped RF bypass capacitors inherent in the design of the stripline circuit.

The RF bypass capacitors 416 are coupled between stripline conductors of the backplane 406 and a ground plane of the backplane 406. Any suitable capacitor may be used but such a capacitor is preferably chosen to minimize size and weight of the RAMC 400. In appropriate configurations, the bypass capacitors may be soldered directly to the printed circuit board forming the RF backplane 406 or they may be integrated into the structure of the RF backplane 406. Such integrated bypass capacitors may be realized by using low impedance striplines, where the capacitance per unit length is enhanced by employing wider striplines and higher dielectric constant materials. The bypass capacitors 416 are required to decouple RF current at the base of the biasing vias.

The ballast resistors 414 are electrically coupled between adjacent patches 410. The ballast resistors generally have a large value (typically 1 MΩ) and ensure an equal voltage drop across each series diode in the strings of diodes that are found between the biasing vias and the grounded vias.

The basic pattern illustrated in FIGS. 4 and 5 may be repeated any number of times in the x and y directions (defined by the coordinate axes shown in FIG. 4). FIGS. 4 and 5 illustrate an RF unit cell 426. The RAMC 400 is characterized by a unit cell 426, which includes, in a first plane including the surface of the FSS 402, a pattern of three or more conductive patches and voltage variable capacitive elements between laterally adjacent conductive patches. One conductive patch of the unit cell is electrically coupled with an associated conductive via 408. In a second plane, the unit cell 426 includes a conductive backplane segment extending substantially parallel to a plane including the three or more conductive patches. The unit cell further includes the associated conductive via extending from the one conductive patch to one of the bias signal lines or grounded vias extending from the RF backplane 406.

Figure 6:
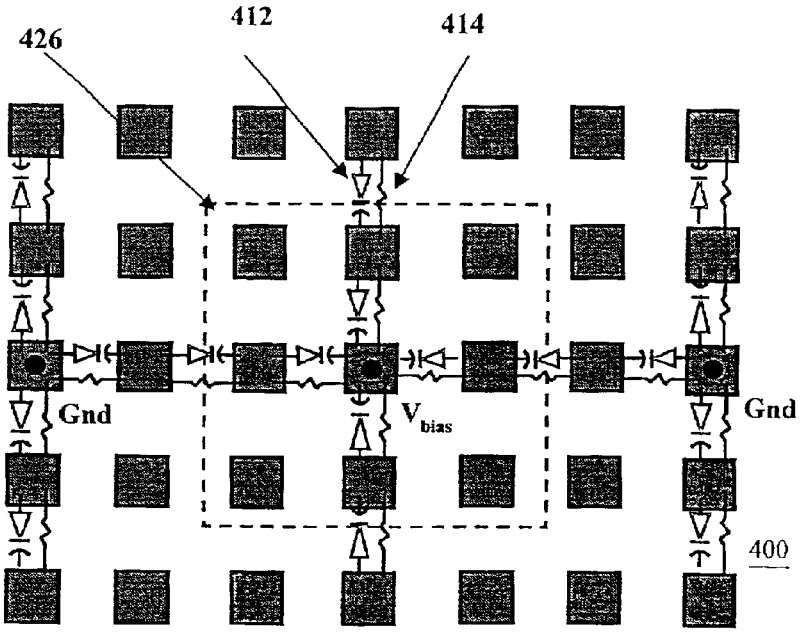
FIG. 6 is a top view of a second embodiment of a reconfigurable artificial magnetic conductor.

FIG. 6 is a top view of a second embodiment of a reconfigurable artificial magnetic conductor 400. In the second embodiment, the varactor diodes 426 are installed in a thinned pattern so as to reduce the capacitance per unit area, as well as the cost, weight and complexity of the RAMC 400. In the exemplary embodiment of FIG. 6, every second and third row and column are not used for integration of the varactor diodes 426. The result is a pattern of strings of diodes 412 and ballast resistors 414 arranged across the surface of the RAMC 400. Alternative embodiments may be designed skipping one, three or N rows of patches between diode strings. Although FIG. 6 implies that patches are uniform in size and shape, this need not be the case. For instance, patches associated with vias may be substantially larger in surface area than patches not associated with vias.

A physical implementation of this embodiment has been fabricated. The best mode of this RAMC is fabricated by sandwiching a 250 mil thick foam core ($\epsilon_r$=1.07) between two printed circuit boards. The upper board is single-sided 60 mil Rogers R04003 board and forms the FSS. Plated through holes are located in the center of one out of every nine square patches, 300 mils on a side with a period of 360 mils. Tuning diodes are M/A-COM GaAs MA46H202 diodes, and the ballast resistors are each 2.2 MΩ chips. The RAMC is assembled by installing 22 AWG wire vias between the FSS board and the RF backplane on 1080 mil centers. The RF backplane is a 3 layer FR4 board, 62 mils thick, which contains an internal stripline bias network. Ceramic decoupling capacitors are used on the bottom side of the RF backplane, one at every biasing via. The total thickness of this fabricated RAMC is approximately 0.375 inches excluding the surface mounted components.

Figure 7:
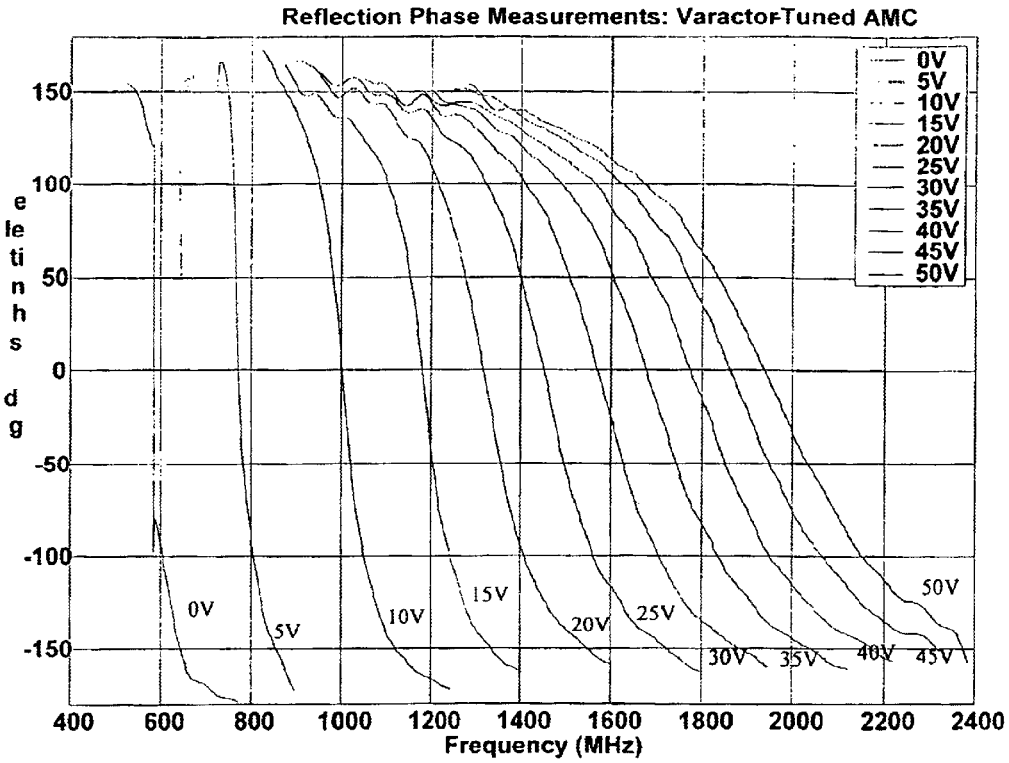
FIG. 7 illustrates reflection phase measurements for a reconfigurable artificial magnetic conductor in accordance with one embodiment of the present invention.

The measured reflection coefficient phase angle versus frequency is shown in FIG. 7 with the varactor bias voltage as a parameter. At each bias level, the instantaneous +/−90-degree bandwidth of the device is relatively narrow. However, as the bias voltage changes, the instantaneous +/−90-degree bandwidth continuously moves across a much wider frequency band, from 600 MHz to 1920 MHz in resonant frequency.

Figure 8:
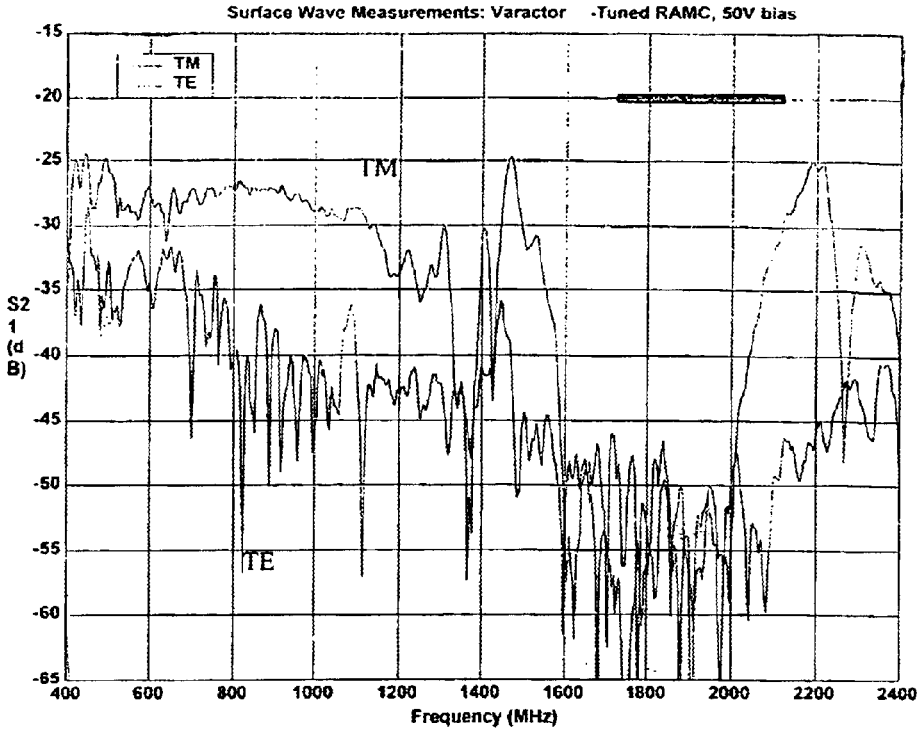
FIG. 8 is a plot of measured TE and TM mode surface wave transmission for a physical embodiment of the reconfigurable artificial magnetic conductor of FIG. 6 with a bias voltage of 50 V.
Figure 9:
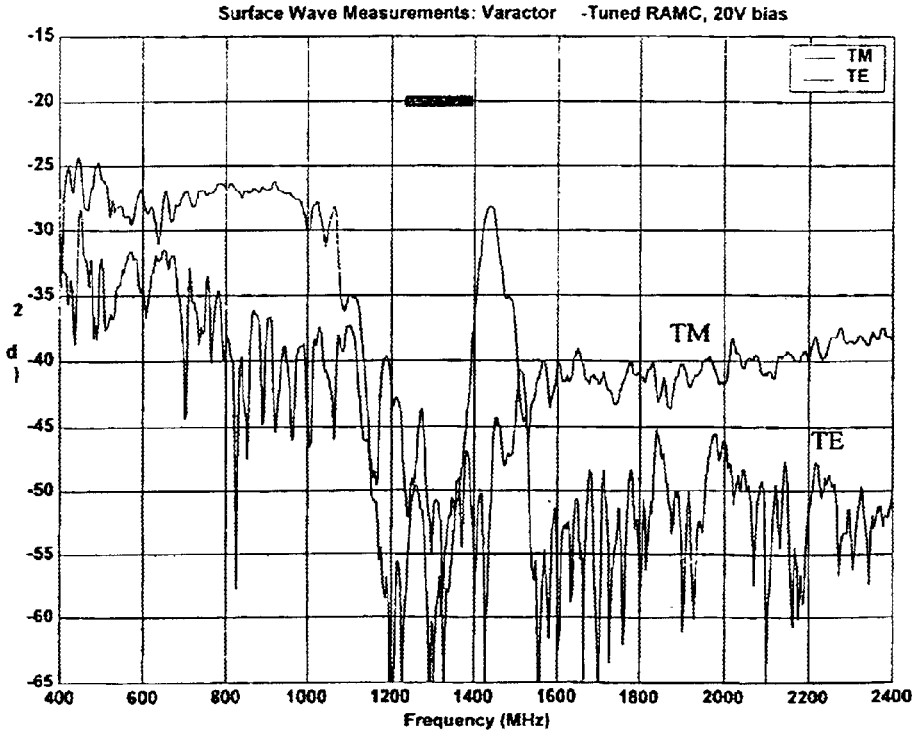
FIG. 9 is a plot of measured TE and TM mode surface wave transmission for a physical embodiment of the reconfigurable artificial magnetic conductor of FIG. 6 with a bias voltage of 20 V.
Figure 10:
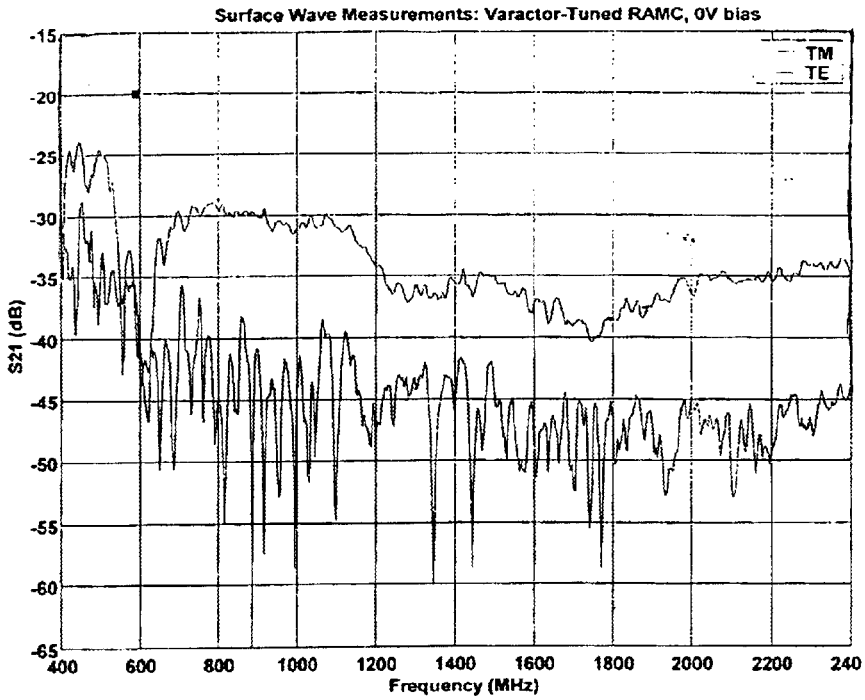
FIG. 10 is a plot of measured TE and TM mode surface wave transmission for a physical embodiment of the reconfigurable artificial magnetic conductor of FIG. 6 with a bias voltage of 0 V.

FIGS. 8, 9 and 10 show the measured $S_{21}$ for the transverse electric (TE) and transverse magnetic (TM ) surface wave coupling for 50, 20 and 0 volt bias levels, respectively. The range of frequencies satisfying the +/−90 degree reflection phase criterion is indicated on each plot. The surface wave bandgaps observed are correlated closely to the +/−90-degree reflection phase bandwidths at each bias level. Broadband antennas, such as spirals, can be mounted in close proximity to the RAMC surface and exhibit good impedance and gain performance over the range of frequencies associated with the surface wave bandgap. As the RAMC is tuned over a wide range of frequencies, the spiral antenna can operate efficiently, even though the entire structure is only $\lambda o/52$ thick at the lowest frequency.

Figure 11:
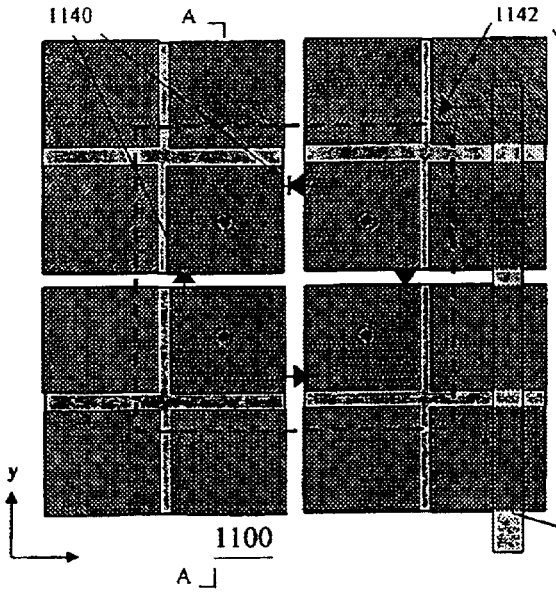
FIG. 11 is a top view of a third embodiment of a reconfigurable artificial magnetic conductor.
Figure 12:
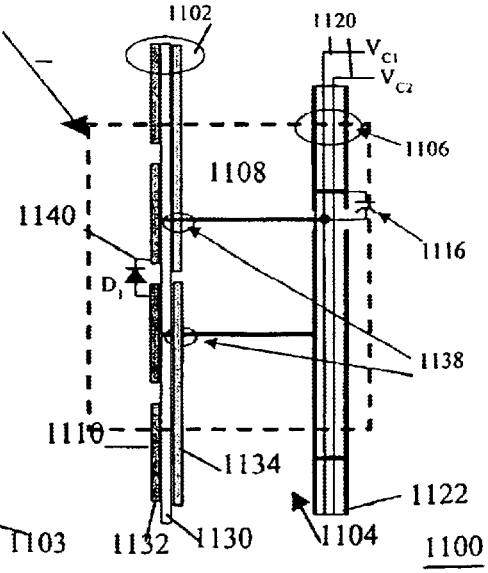
FIG. 12 is a cross sectional view taken along line A—A in FIG. 11.

FIG. 11 and FIG. 12 illustrate a second embodiment of a reconfigurable artificial magnetic conductor (RAMC) 1100. FIG. 11 is a top view of the RAMC 1100. FIG. 12 is a cross sectional view taken along line A—A in FIG. 11.

The RAMC 1100 includes a frequency selective surface (FSS) 1102, a spacer layer 1104 and a radio frequency (RF) backplane 1106. An antenna element 1103 is placed adjacent to the RAMC 1100 to form an antenna system. The backplane 1106 includes one or more bias voltage lines 1120 and a ground plane 1122. In one embodiment, the backplane is fabricated using printed circuit board technology to route the bias voltage lines. The spacer layer is pierced by conductive vias 1108. The conductive vias 1108 electrically couple bias control signals, communicated on the bias voltage lines 1120 of the conductive backplane, with adjacent conductive patches 1110 of the FSS 1102. The bias signals are labeled $V_{c1}$ and $V_{c2}$ in FIGS. 11 and 12. The bias control signals may be DC or AC signals or a combination of these. In general, the bias signals are generated elsewhere in the circuit including the RAMC 1100. In other embodiments, more or fewer bias signals may be used. The magnitude of the bias signals may be chosen depending on the electronic components and materials used in the RAMC 1100. The backplane 1106 further includes RF bypass capacitors 1116 between respective bias voltage lines 1120 and the ground plane 1122.

The FSS 1102 includes a periodic array of conductive patches 1110. In the embodiment of FIGS. 11 and 12, the FSS 1102 is a two-layer FSS. The FSS 1102 includes a dielectric layer 1130, a first layer 1132 of conductive patches disposed on a first side of the dielectric layer 1130 and a second layer 1134 of conductive patches disposed on a second side of the dielectric layer 1130. Portions of the second layer 1134 of conductive patches overlap portions of the first layer 1132 of conductive patches. The FSS 1102 further includes diode switches between selected patches of the first layer 1132 of conductive patches.

Access holes 1138 are formed in the patches of the inside or second layer 1134 and the dielectric layer 1130 so that the vias 1108 may electrically contact adjacent patches of the outside or first layer 1132. As indicated, the patches of the first layer 1132 are alternately biased to ground or a bias voltage such as $V_{c1}$ $V_{c2}$. In this manner, the capacitance of the FSS 1102 is variable to control resonant frequency of the FSS 1102.

The FSS 1102 further includes PIN diodes 1140. A PIN diode is a semiconductor device having a p-n junction with a doping profile tailored so that an intrinsic layer is sandwiched between a p-doped layer and an n-doped layer. The intrinsic layer has little or no doping. PIN diodes are known to be used in microwave applications as RF switches. They provide a series resistance and series capacitance which is variable with applied voltage, and they have high power-handling capacity. Thus, the PIN diodes are voltage variable capacitive circuit elements. Other suitable types of voltage variable capacitive circuit elements may be substituted for the PIN diodes 1140, such as MEMS switches or MEMS variable capacitors.

Thus, this embodiment of the RAMC 1100 is realized by using PIN diode switches in a two-layer FSS. FIGS. 11 and 12 show the general layout and the biasing scheme. The basic concept is to reconfigure the effective sheet capacitance of the FSS 1102 by using PIN diode switches 1140 to change the density of overlapping printed patches 1110 on the layers 1132, 1134. The vias 1108, indigenous to the high-impedance surface, are used to route bias currents and voltages from stripline control lines 1120 buried inside the RF backplane 1106. Thus, the AMC 1100 has a first set 1132 of conductive patches on one side of an FSS dielectric layer 1130 and a second set 1134 of conductive patches on a second side of the FSS dielectric layer 1130.

The RAMC 1100 may be described as repeated instances of a unit cell 1142. There are four diodes per unit cell. The unit cell includes, in a first plane, a pattern of three or more conductive patches 1110 disposed on a first side of the dielectric layer 1130. Each conductive patch is electrically coupled with an associated conductive via 1108. Also in the first plane, the unit cell includes RF switches, such as the PIN diodes 1140, between selected laterally adjacent conductive patches 1110, each conductive patch overlapping at least in part a spaced conductive patch 1134 on a second side of the dielectric layer 1130. The unit cell 1142 further includes, in a second plane, a conductive backplane 1106 segment extending in a plane substantially parallel to a plane including the three or more conductive patches 1110, with the associated conductive vias extending from the each conductive patch to a bias signal line of the conductive backplane.

Other geometrical configurations of the patches 1110 on the two sides of the dielectric layer 1130 may be selected in order to vary the resonant frequency of the RAMC 1100. In an alternate embodiment, the patches 1110 of a given unit cell 1142 may not be exactly four in number, and they may have a variety of dimensions. For instance, there may be 6 patches in a given unit cell, all of unique dimensions and surface area. The dissimilar surface area is advantageous when the design goal is to offer both fine and coarse tuning choices. An example is illustrated below in FIG. 13.

Consider a large array comprised of the RAMC 1100 as described in FIGS. 11 and 12. The density of "on" cells defines tuning states for a wide range of effective capacitance as seen by x or y-polarized E fields. For instance, the lowest effective FSS capacitance is realized when all PIN diodes are turned off (reverse biased). This results in the highest RAMC resonant frequency, and is referred to as a discrete tuning state of the RAMC. The highest effective FSS capacitance is realized when all of the PIN diodes are turned on (forward biased). This results in the lowest RAMC resonant frequency. Another tuning state, yielding an intermediate resonant frequency, is achieved when only half of the diodes are turned on. Such is the case when all diodes of a given unit cell are either on or off, but the unit cells which are turned on map into a checkerboard pattern across the face of the RAMC. More than two distinct control lines 1120 may be required in the RF backplane 1106, depending on the number of desired tuning states, and the amount of forward bias current that each line is designed to source.

Figure 13:
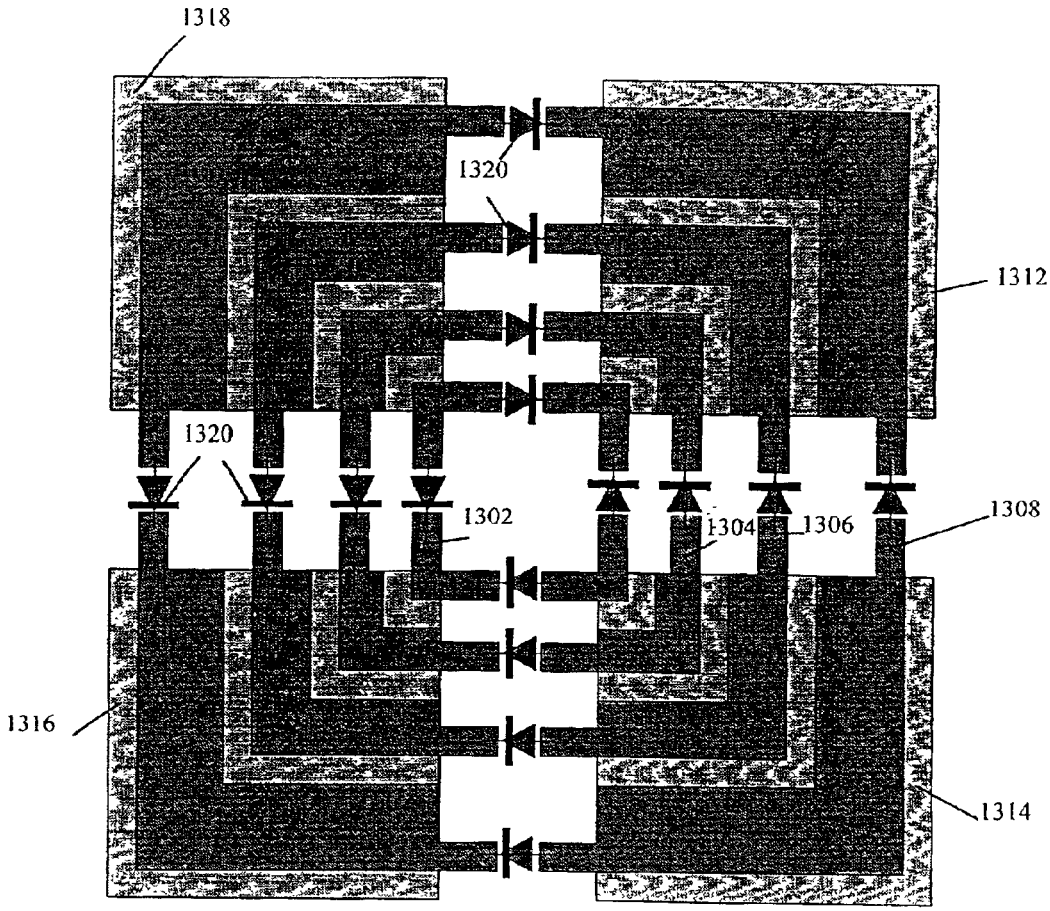
FIG. 13 is a top view of another embodiment of a frequency selective surface for use in a reconfigurable artificial magnetic conductor.

FIG. 13 is a top view of an alternative embodiment of a unit cell of a frequency selective surface 1300 for use in a reconfigurable artificial magnetic conductor. The FSS 1300 provides an alternate realization of the approach to the RAMC design shown in FIGS. 11 and 12. In the embodiment of FIG. 13, the FSS 1300 includes conductive concentric square loops 1302, 1304, 1306, 1308 arranged on a first side of a dielectric layer and conductive square patches 1312, 1314, 1316, 1318 arranged on the second side of the dielectric layer. Each of the concentric loops includes a segment, which at least overlaps one of the patches 1312, 1314, 1316, 1318 and non-overlapping end segments. Non-overlapping segments are coupled at their ends by PIN diodes 1320 or other suitable RF switches. Bias voltages are applied to portions of the respective loops 1302, 1304, 1306, 1308 so as to bias individual PIN diodes into their on or off state. Other geometries may be substituted, for example, using triangular, rectangular, circular or hexagonal loops in place of the square loops 1302, 1304, 1306, 1308.

The embodiment of FIG. 13 achieves sixteen discrete tuning states using four DC control voltages by using a set of overlapping concentric square loops. This assumes that every unit cell receives the same pattern of control signals. Preliminary analysis with a full-wave simulation tool indicates that it may be possible to achieve a tunable bandwidth of greater than 10:1 using embodiments similar to that of FIG. 13.

Figure 14:
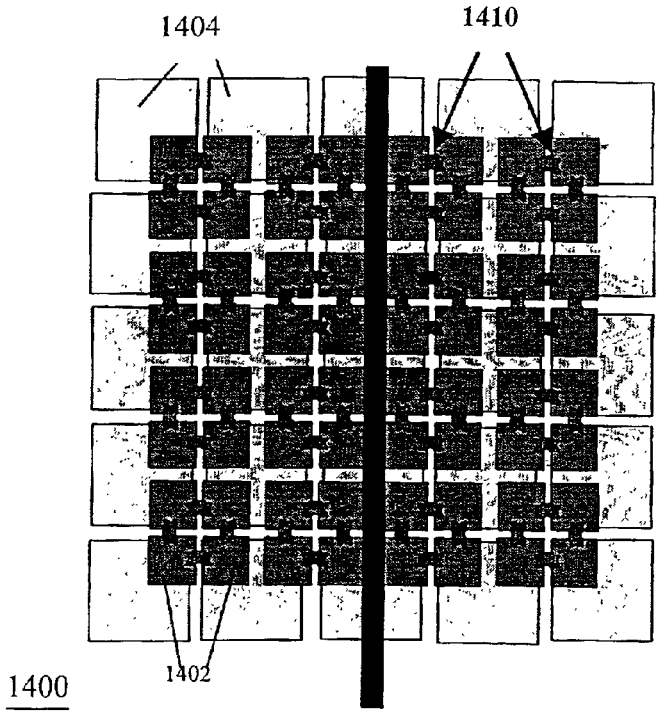
FIG. 14 is a top view of another embodiment of a frequency selective surface for use in a reconfigurable artificial magnetic conductor.
Figure 15:
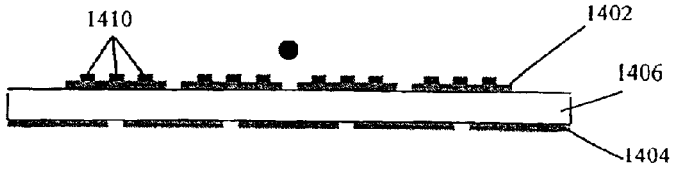
FIG. 15 is a side view of the frequency selective surface of FIG. 14.

FIG. 14 is a top view of another embodiment of a frequency selective surface 1400 for use in a reconfigurable artificial magnetic conductor (RAMC). FIG. 15 is a side view of the FSS 1400 of FIG. 14. In the embodiment of FIG. 14, a first periodic array of conductive patches 1402 is disposed on a first side of a dielectric layer 1406. A second periodic array of conductive patches 1404 is disposed on the second side of the dielectric layer 1406. Patches 1402 of the first array on the first side of the dielectric layer 1410 overlap patches 1404 of the second array on the second side. The geometries and relative dimensions shown in FIGS. 14 and 15 are exemplary only and may be varied to provide particular operational characteristics.

The FSS 1400 further includes micro-electromechanical systems (MEMS) switches 1410 disposed between adjacent patches 1402 of the first array. MEMS switches are electromechanical devices, which can provide a high ratio of ON to OFF state capacitance between terminals of the device. So the capacitive reactance between RF terminals can be controlled or adjusted over a very large ratio. Another broad class of MEMS switch is a type that provides an ohmic contact, which is either open (OFF) or closed (ON). An ohmic contact MEMS switch most closely emulates the function of a PIN diode since the series resistance between RF terminals is switched between low (typically <1 Ω) and high (typically >10 MΩ) values. MEMS switches are known for use in switching applications, including in RF communications systems. RF MEMS switches have electrical performance advantages due to their low parasitic capacitance and inductances, and absence of nonlinear junctions. This results in improved insertion loss, isolation, high linearity and broad bandwidth performance. Published MEMS RF switch designs use cantilever switch, membrane switch and tunable capacitor structures. The capacitance ratio of a capacitive type MEMS switch is variable in response to a control voltage, typically 25:1 minimum. As in the embodiments of FIG. 4 and FIG. 11, the control voltages for the MEMS switches may be routed through the vias that are intrinsic to the spacer layer of the RAMC including the FSS 1400 (not shown in FIG. 14).

Figure 19:
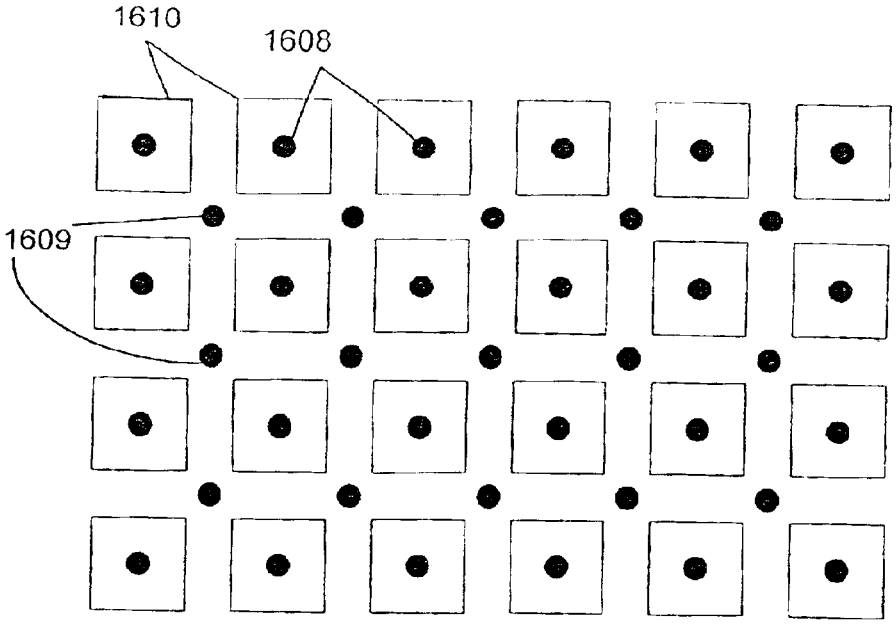
FIG. 19 is a top view of the prior art artificial magnetic conductor of FIG. 16.

FIG. 16 is a cross sectional view of a prior art artificial magnetic conductor (AMC) 1600. FIG. 19 is a top view of the AMC 1600. The AMC 1600 includes a frequency selective surface (FSS) 1602, a spacer layer 1604, and a ground plane 1606. The FSS 1602 includes a first pattern of first patches 1610 on a first side of a dielectric layer 1614 and a second pattern of second patches 1612 on a second side of the dielectric layer 1614. The spacer layer 1604 is pierced by a forest of vias including vias 1608 associated with first patches 1610 and vias 1609 associated with second patches 1612. Each via 1608, 1609 has a one-to-one association with a first patch 1610 and a second patch 1612, respectively, of the FSS 1602. That is, each patch 1610, 1612 has associated with it one and only one via 1608, 1609, and each via 1608, 1609 is associated with one and only one patch 1610, 1612.

Figure 20:
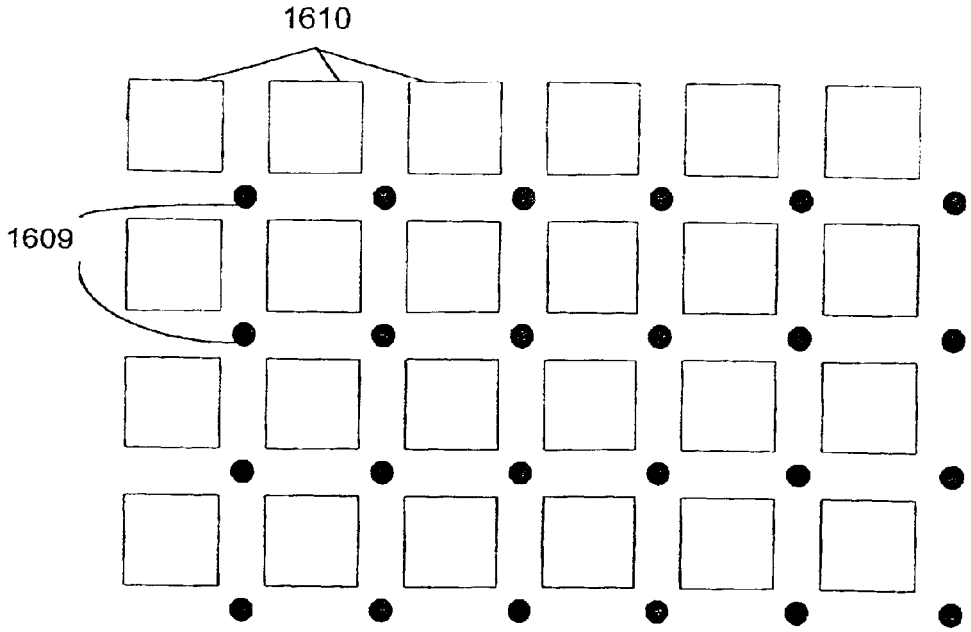
FIG. 20 is a top view of the first embodiment of the artificial magnetic conductor of FIG. 17.

FIG. 17 is a cross sectional view of a first embodiment of an artificial magnetic conductor (AMC) 1600 with a reduced number of vias 1608 in the spacer layer 1604. FIG. 20 is a top view of this same embodiment. In the embodiment of FIGS. 17 and 20, vias 1609 connect only to the lower or second patches 1612. The vias 1608 which in the embodiment of FIG. 16 had been associated with the upper or first patches 1610 are omitted. The vias 1609 are associated only with the second patches 1612. The vias 1609 may be electrically coupled with their associated patches or they may be separated from the patches 1612 by a dielectric. This can be achieved, for example, if the patches 1612 are annular with the via passing through the central region. Thus, in FIG. 17, the spacer layer of the AMC 1600 has conductive vias associated with some or all of only the first set of conductive patches formed on one side of the dielectric layer of the FSS.

Also, in FIG. 17, the vias 1609 are shown extending above the plane of the patches 1612 to the plane of the patches 1610. Alternatively, the vias 1609 may be truncated at any suitable level in the cross section of the AMC 1600.

Figure 21:
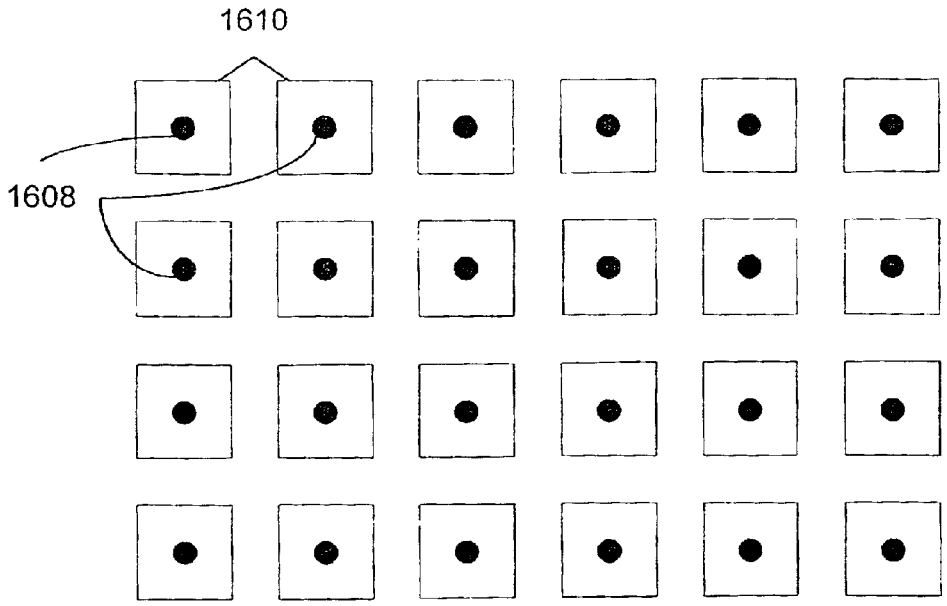
FIG. 21 is a top view of the second embodiment of the artificial magnetic conductor of FIG. 18.

FIG. 18 is a cross sectional view of a second embodiment of an artificial magnetic conductor (AMC) 1600 with a reduced number of vias in the spacer layer 1604. FIG. 21 shows a top view of this same embodiment. In the embodiment of FIGS. 18 and 21, the vias 1608 are associated only with patches 1610 of the first or upper layer of patches. Patches 1612 of the second or lower layer of patches do not have vias 1608 associated with them. As in FIGS. 17 and 20, the vias 1608 may or may not electrically connect with the patches 1610 and the length of the vias 1608 may be selected according to performance and manufacturing requirements. Thus, in FIG. 18, the spacer layer 1604 of the AMC 1600 has conductive vias associated with some or all of only the second set of conductive patches formed on one side of the dielectric layer of the FSS. Further, in the embodiments both FIGS. 17, 20 and FIGS. 18, 21, the ground plane 1606 illustrated in the figures may be replaced with an RF backplane of the type described above and including one or more ground planes and one or more striplines or other circuits or devices.

Figure 22:
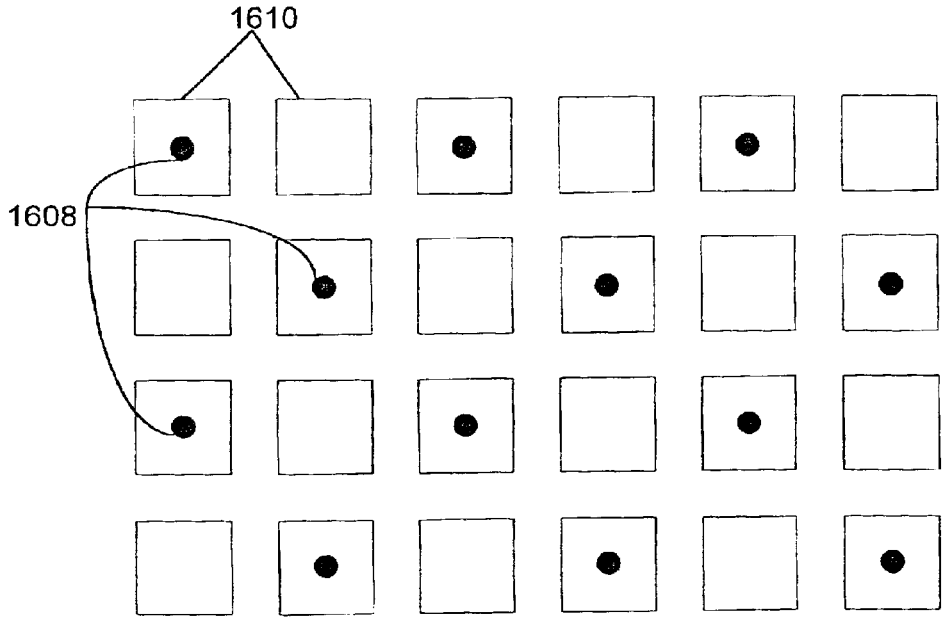
FIG. 22 is a top view of an alternative embodiment of the artificial magnetic conductor of FIG. 18.
Figure 23:
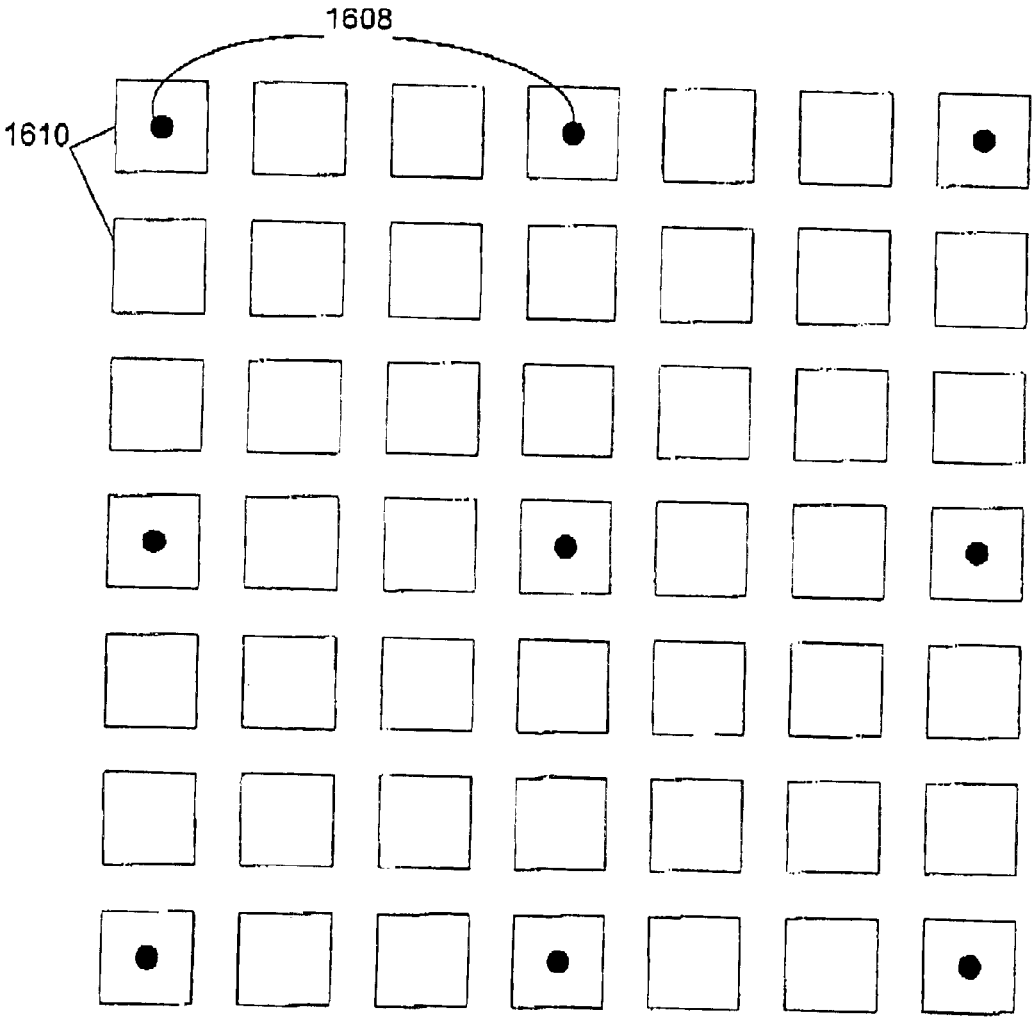
FIG. 23 is a top view of another alternative embodiment of the artificial magnetic conductor of FIG. 18.

FIG. 22 and FIG. 23 show an alternative embodiment of an AMC featuring a partial forest of vias 1608. In the embodiment of FIG. 21, one-half the total number of vias was provided in the spacer layer by omitting vias associated with the second layer of patches 1612. In the embodiment of FIG. 22, one in every four vias is installed by including only some vias associated with the first layer of patches 1610 (omitting all vias associated with the second layer of patches 1612). In FIG. 22, the installed vias 1608 form a checkerboard pattern, with a via present for every other patch 1610 along the rows and columns of patches. Similarly, FIG. 23 shows one of every eighteen vias installed, relative to a fully populated forest of vias as shown in FIG. 19. Other configurations such as non-checkerboard patterns could be used as well. For example, the patterns could be non-uniform along rows or columns of patches 1610 or in varying regions of the AMC 1600. A pattern of vias associated with one or both layers of patches 1610, 1612 may be chosen to achieve particular performance goals for the AMC or associated equipment.

Thus, the present embodiments provide an artificial magnetic conductor (AMC) which includes a partial forest of vias in the spacer layer. By partial forest, it is meant that some of the vias of the AMC are omitted. The omitted vias may be those related to patches on a particular layer or to patches in a particular region of the plane of the spacer layer. The resulting partial forest of vias may be uniform across the structure of the AMC or may be non-uniform.

The AMC of the embodiments illustrated herein includes a frequency selective surface (FSS) having a pattern of conductive patches, a conductive backplane structure, and a spacer layer separating the FSS and the conductive backplane structure. The spacer layer includes conductive vias associated with some but not all patches of the pattern of conductive patches. While the illustrated embodiments show omission of vias associated with patches on a single layer, other patterns of via omission may be implemented as well, including omitting vias from a region of the AMC when viewed from above.

Other embodiments may be substituted as well, as indicated above. In one embodiment, the backplane includes one or more ground planes and conductive vias are in electrical contact with the ground plane. In another embodiment, the backplane includes bias signal lines which are in electrical contact with a subset or all of the vias. By selective application of bias signals, the effective sheet capacitance of the AMC may be varied to tune the AMC. In still another embodiment, the backplane includes both a ground plane or ground planes and bias signal lines.

In still another embodiment, the AMC includes a single layer of conductive patches on one side of a dielectric layer. In the simplest embodiment, a subset of the patches have associated with them vias in the spacer layer shorted to a ground plane. For example, alternate patches may have vias omitted from the forest of vias creating a partial forest of vias in a checkerboard pattern. Other patterns may be chosen as well to tailor the performance of the AMC. In other embodiments, the dielectric layer is tunable so that the AMC is resonant at more than one selectable frequency or bands of frequencies. In such an embodiment, some or all of the vias may be electrically biased to control the tuning of the AMC. Biasing signals may be applied from the backplane or generally from behind the AMC, or biasing signals may be applied from in front of the AMC such as through a biasing network of resistors or other components. In yet another embodiment, the AMC includes first and second layers of conductive patches on opposing sides of a dielectric film.

From the foregoing, it can be seen that the present embodiments provide a tunable, or reconfigurable, artificial magnetic conductor which allows for a wider frequency coverage for a given AMC thickness. Variable capacitance circuit elements are included in the frequency selective surface of the AMC and controlled by applied bias voltages to produce a variable effective sheet capacitance for the FSS, which is variable to control resonant frequency of the RAMC. The bias and ground voltages may be routed in stripline conductors, a ground plane or other conductors of the backplane of the AMC. Since the AMC uses vias in the spacer layer, the vias may conveniently be used to route the bias voltages from the backplane to patches of the FSS. This reduces the physical size and weight of the FSS and produces an FSS that may readily be manufactured, for example, using conventional printed circuit board techniques.

While a particular embodiment of the present invention has been shown and described, modifications may be made. For example, while the embodiments described herein have been shown implemented using printed circuit board technology, the concepts described herein may be extended to integration in a single semiconductor device such as an integrated circuit or wafer of processed semiconductor material. This is especially attractive for the integration of MEMS switches. Such an embodiment may provide advantages of increased integration, and reduced size or reduced weight, or reduced cost. It is therefore intended in the appended claims to cover such changes and modifications which follow in the true spirit and scope of the invention.

What is claimed is:

1. An artificial magnetic conductor (AMC) comprising:

a frequency selective surface (FSS) including voltage variable capacitive elements to give the FSS an effective sheet capacitance which is variable to control resonant frequency of the AMC.

2. The AMC of claim 1 wherein the FSS comprises:

a first layer of conductive patches disposed on a first side of a dielectric layer;

a second layer of conductive patches disposed on a second side of the dielectric layer, portions of the second layer of conductive patches overlapping portions of the first layer of conductive patches; and radio frequency (RF) switches between selected patches of the first layer of conductive patches.

3. The AMC of claim 2 wherein the RF switches comprise PIN diode switches.

4. The AMC of claim 2 wherein the RF switches comprise microelectrical-mechanical system (MEMS) switches.

5. The AMC of claim 2 further comprising:

a conductive backplane structure; and a spacer layer separating the FSS and the conductive backplane structure, the spacer layer pierced by conductive vias electrically coupling bias signals between the conductive backplane structure and adjacent conductive patches.

6. An artificial magnetic conductor (AMC) comprising:

a frequency selective surface (FSS) having conductive patches disposed thereon;

a conductive backplane structure;

a spacer layer separating the conductive backplane structure and the FSS, the spacer layer including conductive vias extending between the conductive backplane structure and the FSS; and voltage variable capacitive circuit elements coupled between conductive patches of the FSS and responsive to one or more bias signal lines routed through the conductive backplane structure and the conductive vias.

7. The AMC of claim 6 wherein the FSS comprises a dielectric layer with a single layer of conductive patches disposed on a side of the dielectric layer.

8. The AMC of claim 7 wherein conductive patches of the layer of conductive patches are substantially square.

9. The AMC of claim 7 wherein first predetermined conductive vias are arranged to electrically couple a bias voltage line and respective adjacent conductive patches and second predetermined conductive vias are arranged to electrically couple a ground plane and respective adjacent conductive patches.

10. The AMC of claim 6 wherein the conductive backplane structure comprises a stripline circuit with one or more bias control signals routed in between ground planes of the stripline circuit.

11. The AMC of claim 6 wherein the conductive backplane structure comprises a stripline circuit and distributed or lumped RF bypass capacitors inherent in the design of the stripline circuit.

12. An artificial magnetic conductor (AMC) comprising:

a frequency selective surface (FSS) including a periodic array of conductive patches;

a spacer layer including vias extending therethrough in association with predetermined conductive patches of the FSS; and a conducting backplane structure including two or more bias signal lines, the AMC characterized by a unit cell including in a first plane, a pattern of three or more conductive patches, one conductive patch electrically coupled with an associated conductive via, and voltage variable capacitive elements between selected laterally adjacent conductive patches; and a conductive backplane segment extending in a second plane substantially parallel to a plane including the three or more conductive patches and the associated conductive via extending from the one conductive patch to one of the two or more bias signal lines.

13. The artificial magnetic conductor (AMC) of claim 12, wherein the two or more bias signal lines include a ground line and a bias voltage line.

14. The artificial magnetic conductor (AMC) of claim 12 wherein the periodic array comprises a square lattice of four conductive patches.

15. The artificial magnetic conductor (AMC) of claim 12 wherein the voltage variable capacitive elements comprise varactor diodes.

16. The artificial magnetic conductor (AMC) of claim 15 further comprising ballast resistors coupled in parallel with the varactor diodes.

17. An artificial magnetic conductor (AMC) comprising:

a frequency selective surface (FSS) including a periodic array of conductive patches;

a spacer layer including vias extending therethrough in association with predetermined conductive patches of the FSS; and a conducting backplane structure including two or more bias signal lines, the AMC characterized by a unit cell including in a first plane, a pattern of three or more conductive patches disposed on a first side of a dielectric layer, each conductive patch electrically coupled with an associated conductive via, and radio frequency (RF) switch elements between laterally adjacent conductive patches, each conductive patch overlapping at least in part a spaced conductive patch of a plurality of spaced conductive patches disposed on a second side of the dielectric layer; and in a second plane, a conductive backplane segment extending in a plane substantially parallel to a plane including the three or more conductive patches and the associated conductive vias extending from the each conductive patch to one of the two or more bias signal lines.

18. The AMC of claim 17 wherein the each conductive patch overlaps a spaced conductive patch which is common with horizontally adjacent and vertically adjacent unit cells of the FSS.

19. The artificial magnetic conductor (AMC) of claim 17 wherein the RF switch elements comprise PIN diodes.

20. The artificial magnetic conductor (AMC) of claim 17 wherein the RF switch elements comprise microelectrical-mechanical system (MEMS) switches.

21. A method for reconfiguring an artificial magnetic conductor (AMC) including a frequency selective surface (FSS) having a pattern of conductive patches, a conductive backplane structure and a spacer layer separating the FSS and the conductive backplane structure, the method comprising:

applying control bias signals to voltage variable capacitive elements associated with the FSS; and thereby, reconfiguring effective sheet capacitance of the FSS.

22. The method of claim 21 wherein applying bias control signals comprises applying the bias control signals to conductors located in the conductive backplane structure and coupled to selected conductive patches by conductors extending through the spacer layer.

23. The method of claim 21 further comprising:

tuning a resonant frequency of the AMC.

24. An artificial magnetic conductor (AMC) comprising:

a frequency selective surface (FSS) having a pattern of conductive patches;

a conductive backplane structure; and a spacer layer separating the FSS and the conductive backplane structure, the spacer layer including conductive vias associated with some but not all patches of the pattern of conductive patches.

25. The AMC of claim 24 wherein the conductive backplane structure comprises at least one ground plane, the conductive vias being in electrical contact with the at least one ground plane.

26. The AMC of claim 24 wherein the FSS comprises:

a first set of conductive patches on one side of an FSS dielectric layer, a second set of conductive patches on a second side of the FSS dielectric layer.

27. The AMC of claim 26 wherein the spacer layer has conductive vias associated with some but not all of only the first set of conductive patches.

28. The AMC of claim 27 wherein the spacer layer has conductive vias associated with some but not all of only the second set of conductive patches.

29. The AMC of claim 24 wherein the conductive backplane structure comprises bias signal lines in electrical contact with at least a subset of the conductive vias.

30. The AMC of claim 29 wherein the conductive backplane structure further comprises at least one ground plane, at least a second subset of the conductive vias being in electrical contact with the at least one ground plane.

31. The AMC of claim 24 wherein the FSS comprises:

a layer of conductive patches on one side of a dielectric layer.

32. The AMC of claim 24 wherein the FSS comprises:

a layer of conductive patches on one side of a tunable dielectric layer.

33. The AMC of claim 24 wherein the FSS comprises:

a first layer of conductive patches on one side of a tunable dielectric film; and a second layer of conductive patches on a second side of the tunable dielectric film.

34. The AMC of claim 33 wherein the spacer layer comprises:

a first set of conductive vias associated with at least some patches of the first layer of conductive patches; and a second set of conductive vias associated with at least some patches of the second layer of conductive patches.

35. A high impedance surface comprising:

a frequency selective surface (FSS) patterned with conductive patches;

a conductive ground plane; and a layer separating the FSS and the conductive ground plane, the layer including a dielectric material pierced by a partial forest of conductive vias.

36. An artificial magnetic conductor (AMC) comprising:

a frequency selective surface (FSS) having a single layer of conductive patches disposed on a dielectric layer and an effective sheet capacitance which is able to control resonant frequency of the AMC; and voltage variable capacitors between selected conductive patches.

37. The AMC of claim 36 wherein the voltage variable capacitors comprise microelectrical-mechanical system (MEMS) based variable capacitors.

38. The AMC of claim 36 wherein the voltage variable capacitors comprise varactor diodes.

39. The AMC of claim 38 further comprising:

ballast resistors between the selected conductive patches.

40. The AMC of claim 38 further comprising:

a conductive backplane structure; and a spacer layer separating the FSS and the conductive backplane structure, the spacer layer pierced by conductive vias electrically coupling bias signals between the conductive backplane structure and adjacent conductive patches.

41. An artificial magnetic conductor (AMC) comprising:

a frequency selective surface (FSS);

a conductive backplane structure;

a spacer layer separating the conductive backplane structure and the FSS, the spacer layer including conductive vias extending between the conductive backplane structure and the FSS;

voltage variable capacitive circuit elements coupled with the FSS and responsive to bias signals on one or more bias signal lines routed through the conductive backplane structure and the conductive vias; and ballast resistors coupled in parallel with the voltage variable capacitive circuit elements.

42. An artificial magnetic conductor (AMC) comprising:

a frequency selective surface (FSS) including a dielectric layer with a first layer of conductive patches disposed on one side of the dielectric layer and a second layer of conductive patches disposed on a second side of the dielectric layer to at least partially overlap conductive patches of the first layer of conductive patches;

a conductive backplane structure;

a spacer layer separating the conductive backplane structure and the FSS, the spacer layer including conductive vias extending between the conductive backplane structure and the FSS; and voltage variable capacitive circuit elements coupled with the FSS and responsive to one or more bias signal lines routed through the conductive backplane structure and the conductive vias.

43. The AMC of claim 42 wherein a first subset of the conductive vias electrically couple a first bias signal line and associated conductive patches according to a first pattern on the one side of the dielectric layer and a second subset of the conductive vias electrically couple a second bias signal line and associated conductive patches according to a second pattern on the one side of the dielectric layer.

* * * * *